US006438832B1

(12) United States Patent
Costa

(10) Patent No.: US 6,438,832 B1
(45) Date of Patent: Aug. 27, 2002

(54) METHOD OF FORMING LAYERED METAL COMPONENTS

(76) Inventor: Larry J. Costa, 54201 Ash Rd., Osceola, IN (US) 46561

( * ) Notice: Subject to any disclaimer, the term of this patent is extended or adjusted under 35 U.S.C. 154(b) by 0 days.

(21) Appl. No.: 09/510,962

(22) Filed: Feb. 21, 2000

(51) Int. Cl.[7] ..... H01R 43/00

(52) U.S. Cl. ..... 29/885; 29/884; 29/874; 29/566.2; 29/566.3; 72/325; 439/886; 439/931; 257/736

(58) Field of Search ..... 29/885, 884, 874, 29/566.1, 566.2, 566.3; 72/325; 439/886, 887, 931; 257/666, 668, 736, 692

(56) References Cited

U.S. PATENT DOCUMENTS 871,685 A * 11/1907 Freier ..... 29/885
5,458,158 A * 10/1995 Kawanabe ..... 29/566.3
6,232,651 B1 * 5/2001 Lee et al. ..... 257/666
6,278,176 B1 * 8/2001 Nakamura et al. ..... 257/668

* cited by examiner

*Primary Examiner*—Rick K. Chang
(74) *Attorney, Agent, or Firm*—Thomte, Mazour & Niebergal; Shane M. Niebergall

(57) ABSTRACT

A method of producing layered metal components is described which obviates the need for layering the terminals twice. The method includes the steps of providing a strip of base material, layering the base material with layering material, and cutting individual pieces from the strip such that the layering material is wiped across the surface of the base material which would otherwise be exposed by the separation.

12 Claims, 3 Drawing Sheets

METHOD OF FORMING LAYERED METAL COMPONENTS

BACKGROUND OF THE INVENTION

The present invention relates to the manufacture of layered metal components and particularly to electrical terminals having solder cladding.

Description of the Prior Art

Electrical terminals must be connected to certain articles of manufacture to allow for the flow of electricity from one medium to a different medium. This is particularly true in instances where the conductive elements are embedded in a non-conductive material, such as glass or dielectric substrate. In, for instance, automotive glass panels having electrical wiring embedded therein for the purpose of defogging the window, electrical terminals must be attached to the glass panels to provide a point of connection for electrical current input and output.

Currently, such terminals are manufactured beginning with the step of obtaining a ribbon of copper, then cleaning, tin-plating, and reeling the ribbon. The ribbon is de-reeled, clad with a solder material on one side, and re-reeled. The ribbon of solder-clad copper is fed into a progressive stamping die that blanks out the flat terminal, then forms the terminal into its final shape. The terminals are connected to a carrier strip which is used to transfer the terminals along the multiple stations of the progressive stamping dye. The progressive stamping die cuts the individual terminal off of the carrier strip at its last station. The individual terminals are optionally cleaned and reclad with tin-plating or solder to cover the exposed copper where it was cut from the carrier strip.

The prior art method of forming electrical terminals has the disadvantage of producing a terminal with exposed copper. Such a terminal is subject to deterioration by oxidation. Alternatively, the terminals must be individually reclad to seal the copper. The task of cladding individual terminals adds expense to the process.

SUMMARY OF THE INVENTION

A method of producing layered metal components such as clad electrical terminals is described which obviates the need for cladding the terminals twice. The method of this invention includes the steps of providing a strip of base material, depositing a layer of material on the base material, such as cladding material, and cutting individual pieces from the strip in such a manner that the cladding material is wiped across the surface of the base material which would otherwise be exposed by the separation. The method optimally incorporates the use of a comparatively brittle base material, such as copper. The method also optimally includes the use of a soft layering material such as solder, or other lead-tin alloys. Finally, the method works best when a stepped punch is used to cut the individual terminals. The stepped punch includes a fine edge which trims the soft layering material, and a wider edge which both severs the base material and wipes the soft layering material over the newly exposed base material. A stepped die may be used rather than or in addition to a stepped punch.

It is therefore a principal object of the invention to provide a method of producing metal components which method includes the step of layering integrated components with layering material only once, but which produces individual components that are entirely covered with layering material.

It is another object of this invention to provide a method of forming electrical terminals which allows for the layering of integrated terminals, but which does not require re-layering of separated terminals.

Yet another object of this invention is to provide a method of producing layered metal components which are durable and inexpensive of manufacture.

These and other objects will be apparent to those skilled in the art.

DESCRIPTION OF THE PREFERRED EMBODIMENT

Figure 1:
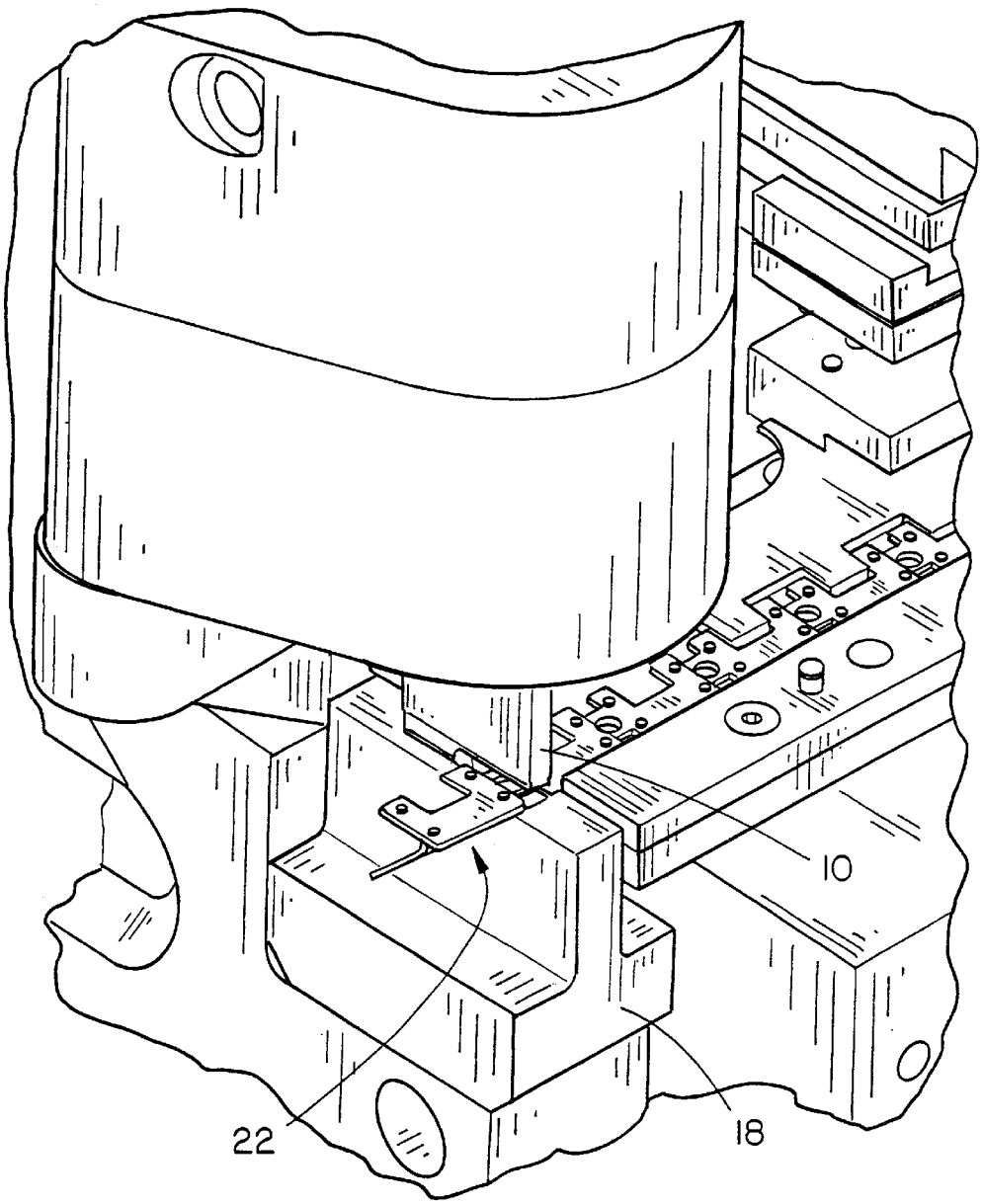
FIG. 1 is an isometric view of an assembly employing the method of this invention.
Figure 2:
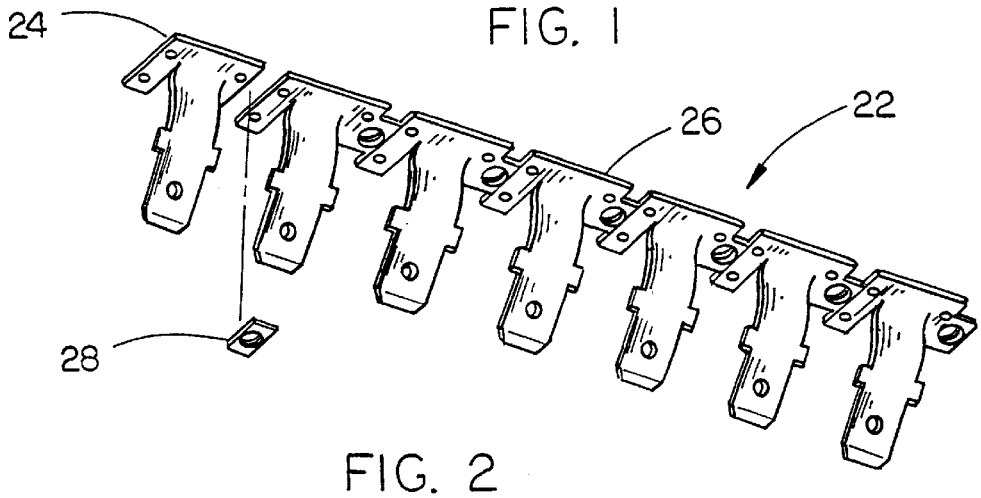
FIG. 2 is an isometric view of integrated electrical terminals and a separated electrical terminal

The numeral 10 refers to a punch which is used in this novel method. The punch 10 includes a cutting end 12 and a support end 14. The cutting end 12 is adapted to fit in the aperture 16 of a mating die 18. The support end 14 is connected to a press 20 which moves the punch 10 into and out of the mating die 18.

The punch 10 and mating die 18 are adapted to sever integrated metal components 22. Although the integrated metal components 22 may comprise coins, jewelry, or other metal parts, for the purposes of this disclosure, the method of this invention will be described as a method of forming individual electrical terminals 24. Similarly, the punch 10 and mating die 18 shown herein produce a straight cut, but can be configured to produce any desired shape. In the exemplary method that is shown, the individual electrical terminals 24 are initially processed as integrated electrical terminals 26. The integrated electrical terminals 26 are formed to include a series of individual electrical terminals 24, each joined to an adjacent terminal by a terminal carrier portion 28.

The integrated electrical terminals 26 are formed of a base material 30, commonly copper. The base material 30 is then layered with layering material 32, such as tin, a tin-lead alloy, or a lead-tin alloy, such as solder. It is also acceptable to layer the base material 30 with tin or a tin-lead alloy, and subsequently apply solder to one side of the electrical terminals. This allows the individual electrical terminals 24 to be pre-soldered for ease of connection, but provides an individual electrical terminal 24 that has a more durable tin or tin-lead alloy plating. The step of layering the layering material 32 on the base material 30 may be completed by any conventional method, such as, but not limited to, electroplating, laminating, spray plating, or cladding. For the application of soldering material to the integrated electrical terminals 26, cladding is the preferred method of layering.

The punch 10 and mating die 18 are employed to remove the terminal carrier portion 28 from the integrated electrical terminals 26 to provide individual electrical terminals 24. The prior art methods of punching out individual electrical terminals in this manner would result in an exposed portion of the base material 30 where the terminal carrier portion 28 would have been removed. The present method prevents this exposure of the base material 30 by wiping the layering material 32 over the base material 30 in the process of severing the individual electrical terminals 24. This step is achieved by manipulation of die clearance.

Die clearance is the ratio of the space between a punch and its mating die, also known as clearance, to the thickness of the material being punched. The die clearance determines the manner in which the material being punched is cut. A punch employing small die clearance values will tend to shear or trim the material. A punch employing larger die clearance values will tend to stretch or tear the material.

The method of this invention employs the method of using a punch 10 that has varying die clearance. Upon initial contact with the integrated electrical terminals 26, the punch 10 should contact the layering material 32 with a punch having a large die clearance. Such a punch has the effect of stretching the layering material 32 downwardly with the cutting end 12 of the punch 10. The punch 10 should then have a smaller die clearance to trim the base material 30 and wipe the stretched layering material 32 over the exposed base material 30.

Figure 3B:
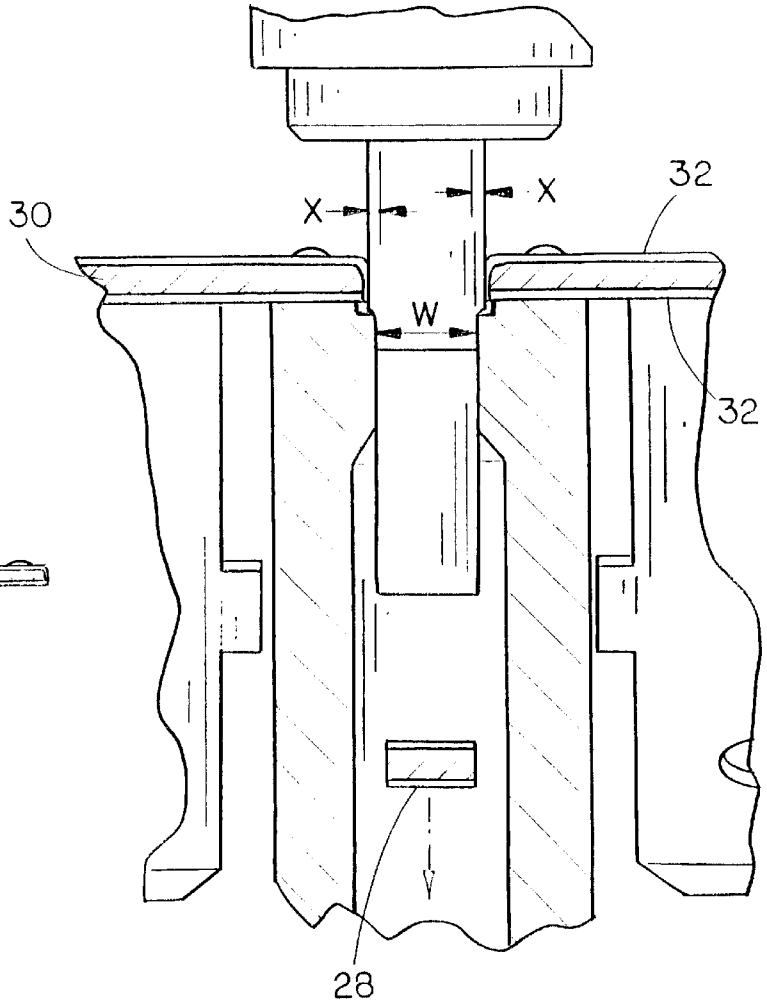
FIG. 3B is a cross section of a metal component being separated from intregated components by the method of this invention.
Figure 3A:
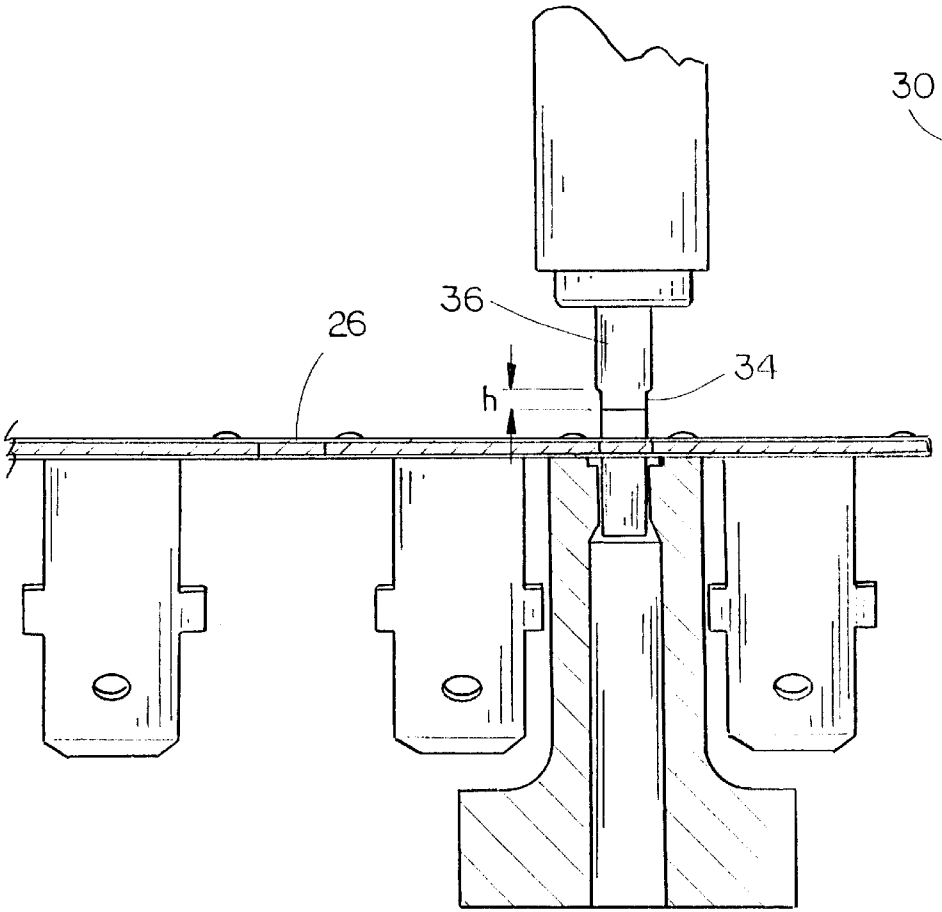
FIG. 3A is a cross-section of a metal component prior to being severed by the method of this invention.
Figure 4:
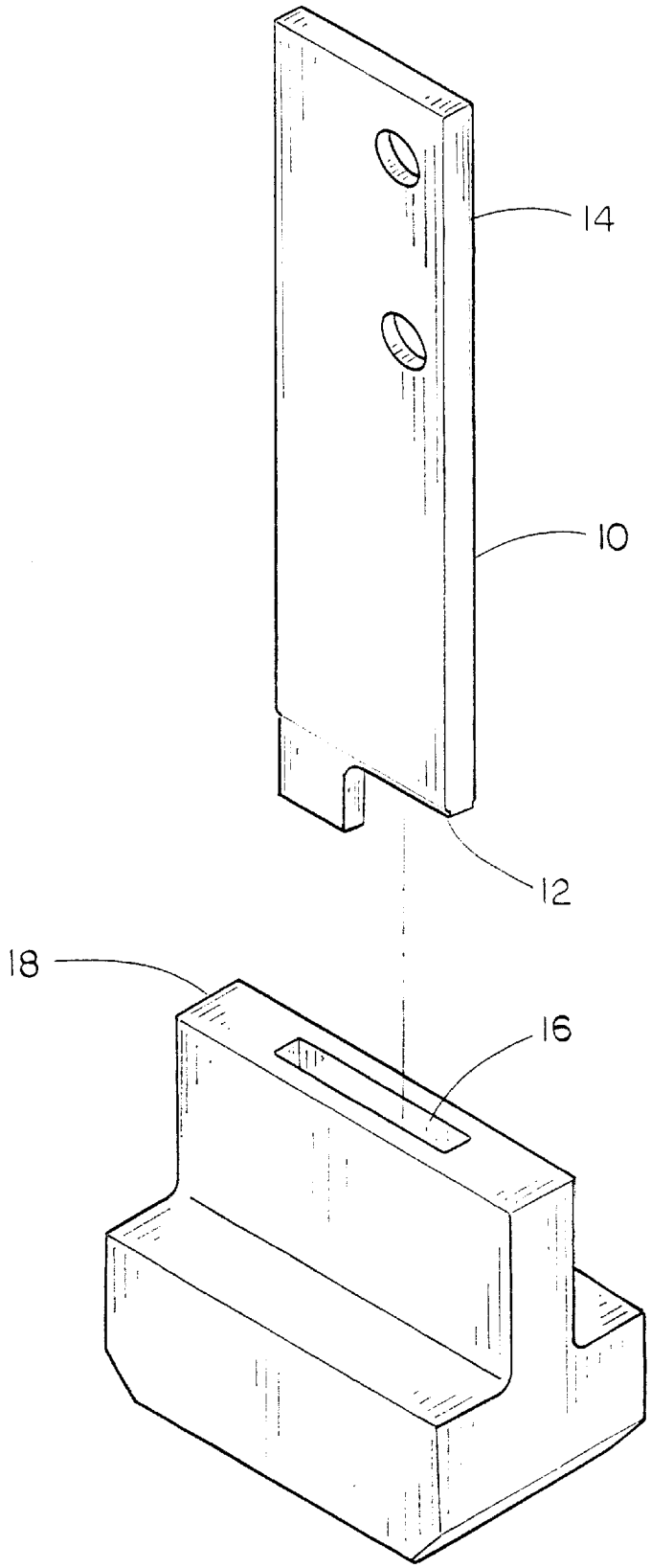
FIG. 4 is an isometric drawing of the punch and mating die.

One manner by which this method may be employed is by using a punch 10 with a cutting edge 12 that is stepped. As seen in FIGS. 3A and 3B, the cutting end 12 has a leading section 34. The leading section 34 has a width (w) and a height (h). The cutting end 12 also has a trailing section 36. The trailing section 36 has a width (w+2×). As the cutting end 12 contacts the integrated electrical terminals 26, the leading section 34, having a larger die clearance, stretches the layering material 32. As the punch 10 continues toward the mating die 18, the trailing section 36 both trims the base material 30 and wipes the layering material 32 over the newly exposed base section 30. The punch 10 continues into the mating die 18 to remove the terminal carrier portion 28 from the integrated electrical terminal 26 to produce an individual electrical terminal 24 that has no exposed base material 30. The die clearance may also be manipulated as described above by providing a stepped die (not shown). The stepped die would have a wider apeture and a stepped, slightly smaller apeture below the upper surface of the die. The die clearance is initially large and, as the material is pushed into the die, becomes small, resulting in a punched piece that is entirely covered with layering material 32.

Thus it can be seen that the present invention achieves at least all of the stated objects of the invention.

I claim:

1. A method of forming individual layered metal components comprising the steps of:

providing a strip comprising adjacent metal components form of a base material;

layering the strip with a layering material; and separating the individual layered metal components from the strip of adjacent components with a punch that causes a cut surface of the base material to become exposed and which causes the layering material to be wiped across the exposed cut surface.

2. The method of claim 1 further wherein said punch is a stepped punch which separates the components, wipes the layering material across the cut surface, and trims the layering material that is wiped across the cut surface.

3. The method of claim 1 wherein the base material is copper.

4. The method of claim 1 wherein the layering material is a tin-lead alloy.

5. The method of claim 4 wherein the layering material is solder.

6. The method of claim 1 wherein the metal components comprise electrical terminals.

7. A method of forming individual layered metal components comprising the steps of:

providing a strip of adjacent metal components formed of a base material;

layering the strip with layering material; and punching the individual components from the strip of adjacent components with a punch and a die wherein at least one of said punch and said die causes a cut surface of the base material to become exposed and causes the layering material to be wiped across the exposed cut surface.

8. The method of claim 7 further comprising a step of providing a punch and a die wherein at least one of said punch and said die is stepped so that said at least one of said punch and said die separates the components, wipes the layering material across the cut surface, and trims the layering material that is wiped across the cut surface.

9. The method of claim 7 wherein the base material is copper.

10. The method of claim 7 wherein the layering material is a tin-lead alloy.

11. The method of claim 10 wherein the layering material is solder.

12. The method of claim 7 wherein the metal components comprise electrical terminals.

* * * * *